US009756924B2

(12) United States Patent
Jang

(10) Patent No.: US 9,756,924 B2
(45) Date of Patent: Sep. 12, 2017

(54) COSMETIC MASK

(71) Applicant: In Sang Jang, Hwaseong-si (KR)

(72) Inventor: In Sang Jang, Hwaseong-si (KR)

( * ) Notice: Subject to any disclaimer, the term of this patent is extended or adjusted under 35 U.S.C. 154(b) by 0 days.

(21) Appl. No.: 15/101,929

(22) PCT Filed: Oct. 21, 2014

(86) PCT No.: PCT/KR2014/009888
§ 371 (c)(1),
(2) Date: Jun. 5, 2016

(87) PCT Pub. No.: WO2015/083938
PCT Pub. Date: Jun. 11, 2015

(65) Prior Publication Data

US 2016/0302551 A1 Oct. 20, 2016

(30) Foreign Application Priority Data

Dec. 6, 2013 (KR) ..... 10-2013-0151588

(51) Int. Cl.
*A45D 34/04* (2006.01)
*A45D 44/00* (2006.01)

(52) U.S. Cl.
CPC ..... *A45D 34/04* (2013.01); *A45D 44/002* (2013.01)

(58) Field of Classification Search
CPC ..... A45D 34/04; A45D 44/22; A45D 44/002; A61M 16/06; A61M 16/0666; A62B 18/02; A62B 18/025; A62B 18/00
See application file for complete search history.

(56) References Cited

U.S. PATENT DOCUMENTS

2003/0196658 A1* 10/2003 Ging ..... A61M 16/06 128/201.22

FOREIGN PATENT DOCUMENTS

| | | | |
|---|---|---|---|
| JP | 2009160077 A | * | 7/2009 |
| KR | 20-0422973 | | 8/2006 |
| KR | 20080043272 A | * | 5/2008 |

* cited by examiner

*Primary Examiner* — Tatyana Zalukaeva
*Assistant Examiner* — Gabriella Burnette
(74) *Attorney, Agent, or Firm* — Steven M. Greenberg; CRGO Law

(57) ABSTRACT

The present invention provides a cosmetic mask comprising: a mask body which is worn on the user's face, and which has a cosmetic liquid supply opening and a respiratory opening formed therethrough; a mist sprayer which is mounted on the mask body to be connected to the cosmetic liquid supply opening, and which sprays a cosmetic liquid into the space between the mask body and the face through the cosmetic liquid supply opening; and a respiratory connector arranged to surround the user's nose portion while being mounted on the mask body to be connected to the respiratory opening, thereby enabling the user to breathe.

11 Claims, 2 Drawing Sheets

[Fig. 1]
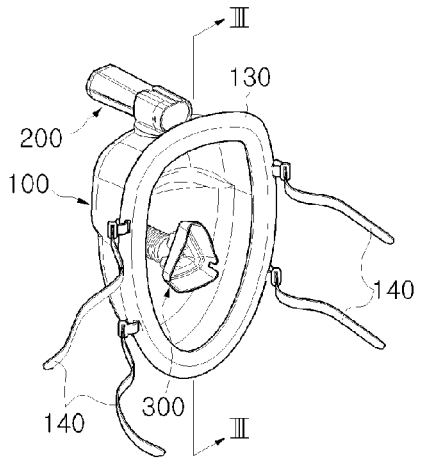
[Fig. 2]
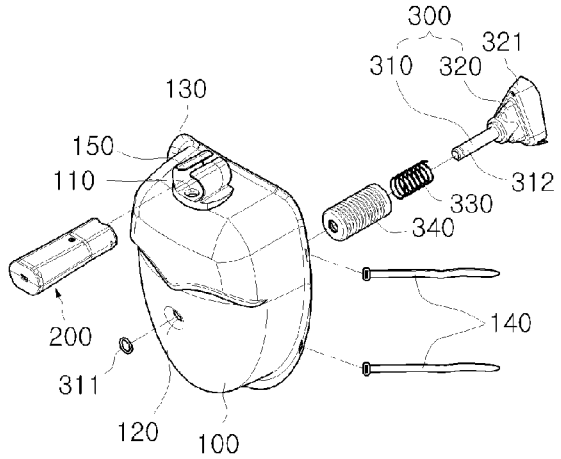
[Fig. 3]
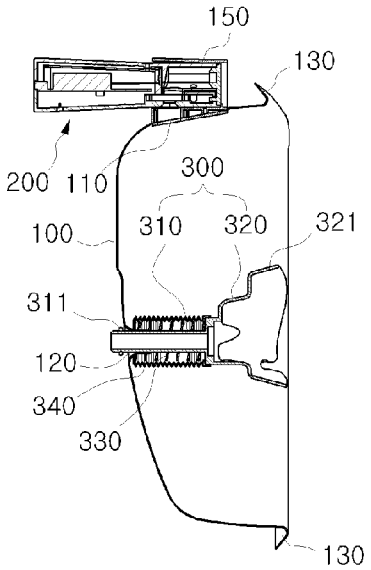

[Fig. 4]
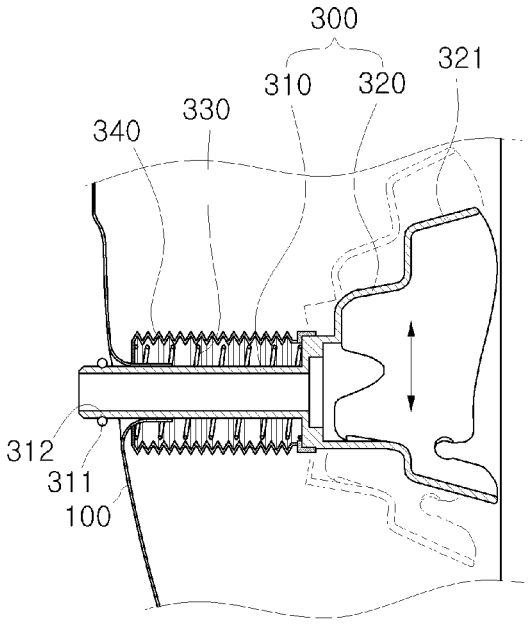

COSMETIC MASK

CROSS-REFERENCE TO RELATED APPLICATIONS

This application is a Submission Under 35 U.S.C. §371 for U.S. National Stage Patent Application of International Application Number PCT/KR2014/009888, filed Oct. 21, 2014, and entitled COSMETIC MASK, which is related to and claims priority to Korean Patent Application Serial Number 10-2013-0151588, filed Dec. 6, 2013, the entirety of both are incorporated herein by reference.

TECHNICAL FIELD

The present invention relates to a cosmetic mask, and more particularly, to a cosmetic mask for supplying a liquid such as a cosmetic liquid onto a face for beauty care.

BACKGROUND ART

A face mask which is a sheet body for makeup is generally used as a cosmetic tool which is used when a liquid such as a cosmetic liquid is supplied onto a facial skin.

The above face mask, which is formed with a single piece of a sheet body, has cutout portions or holes which are formed on portions respectively corresponding to eyes, a nose, and a mouth, and is placed on a face after being impregnated with a liquid such as cosmetic water.

However, when a conventional face mask, which is formed with a single piece of a sheet body, is placed on the whole face having a three-dimensional (3D) curved shape, since the conventional face mask does not uniformly come into close contact with the whole face due to the partial occurrence of wrinkles or sagging, there is a problem in that the cosmetic liquid is not uniformly supplied onto the whole face.

Further, since the cosmetic liquid is absorbed into the sheet body itself of the face mask, there is a problem in that absorption efficiency of the cosmetic liquid into the facial skin is reduced.

The above conventional face mask is provided in Japanese Laid-Open Patent Application No. 2002-172022.

DISCLOSURE

Technical Problem

The present invention is directed to providing a cosmetic mask in which a cosmetic liquid is uniformly supplied onto a whole face and absorption efficiency of the cosmetic liquid into facial skin is improved.

Technical Solution

One aspect of the present invention provides a cosmetic mask including a mask body worn on a user's face and having a cosmetic liquid supply opening and a respiratory opening formed therethrough, a mist sprayer mounted on the mask body to be connected to the cosmetic liquid supply opening and configured to spray a cosmetic liquid into a space between the mask body and the face through the cosmetic liquid supply opening, and a respiratory connector arranged to surround the user's nose portion while being mounted on the mask body to be connected to the respiratory opening, thereby enabling the user to breathe.

Also, a sealing unit having ductility may be coupled to an edge portion of the mask body in contact with the user's face.

Also, an engaging band engaging with the user's head or ears may be further coupled to the edge portion of the mask body.

Also, a mounting bracket, into which one side of the mist sprayer is detachably inserted and mounted, may be coupled to the mask body.

Also, the mounting bracket may have a ring-shaped cross section of which one side is open.

Also, the respiratory connector may include a connecting rod installed to be slidably inserted into the respiratory opening of the mask body in forward and backward directions and having a pipe structure, and a cover body coupled to one end of the connecting rod protruding backward from the mask body to be in communication therewith and having a concave-shaped cross section to cover the user's nose portion.

Also, a contact unit having ductility may be coupled to an edge portion of the cover body in contact with the user's face.

Also, a separation preventing protrusion may be formed protruding from an outside of the other end of the connecting rod protruding forward from the mask body, and an elastic spring may be inserted into an outside of one end of the connecting rod disposed at an inside of the mask body.

Also, the connecting rod may have a bellows structure.

Also, a protective cover may be further installed to be inserted into the outside of the connecting rod to surround the elastic spring.

Also, the protective cover may have a bellows structure.

Advantageous Effects

The cosmetic mask according to the present invention is advantageous in that, when a mask body is worn on a user's face while enabling breathing through a respiratory connector, a cosmetic liquid, which is sprayed through a mist sprayer, comes into direct contact with the user's facial skin through a cosmetic liquid supply opening of the mask body, thereby increasing absorption efficiency of the cosmetic liquid into the user's facial skin.

DESCRIPTION OF DRAWINGS

FIG. 1 is a perspective view of a cosmetic mask according to one embodiment of the present invention.

FIG. 2 is an exploded perspective view of FIG. 1.

FIG. 3 is a cross-sectional view taken along line of FIG. 1.

FIG. 4 is a partially enlarged view of FIG. 3.

MODES OF THE INVENTION

Hereinafter, exemplary embodiments of the invention will be described in detail with reference to the accompanying drawings.

FIG. 1 is a perspective view of a cosmetic mask according to one embodiment of the present invention, FIG. 2 is an exploded perspective view of FIG. 1, FIG. 3 is a cross-sectional view taken along line of FIG. 1, and FIG. 4 is a partially enlarged view of FIG. 3. Referring to FIGS. 1 to 4, the cosmetic mask includes a mask body 100, a mist sprayer 200, and a respiratory connector 300.

The mask body 100 is a portion which is worn on a user's face (not illustrated). The above-described mask body 100 is formed to have a surface facing the user's face having a concave structure so that the surface facing the user's face is disposed adjacent to the user's face. In this case, the surface of the mask body 100 facing the user's face and the user's face are disposed to be spaced apart from each other, and thus a cosmetic liquid sprayed from the mist sprayer 200 to be described below may come into contact with the user's face. In this manner, edge portions of the mask body 100 are worn on the face to be in close contact therewith, and thus the cosmetic liquid sprayed from the mist sprayer 200 to be described below is efficiently absorbed into skin of the face while being distributed adjacent to the face. The above-described mask body 100 may be wholly formed of a transparent material, or only portions at positions facing the user's eye portions may be transparently formed. Also, the mask body 100 may be formed of rubber or a synthetic resin material having ductility, but the present invention is not limited thereto, and the mask body 100 may also be formed of plastic or a synthetic resin material having hardness. In this case, a portion of the mask body 100 corresponding to a forehead of the user's face is formed protruding forward therefrom, and thus a back surface of the mask body 100 may be stably worn on the user's face.

Here, a sealing unit 130 having ductility is coupled to edge ends of the mask body 100, that is, ends which are in contact with the user's face. The above-described sealing unit 130 makes the mask body 100 abut the user's face in a sealed state while the mask body 100 is worn on the user's face and prevents the cosmetic liquid sprayed into a space between the mask body 100 and the user's face from leaking to the outside of the mask body 100. In this case, the sealing unit 130 may be formed to extend toward both the outside and the inside of the mask body 100, and may make the mask body 100 be worn stably in the sealed state regardless of a size of the user's face wearing the mask body 100. Here, the sealing unit 130 may be formed of rubber or a synthetic resin material having ductility.

A cosmetic liquid supply opening 110 connected to the mist sprayer 200 so that the cosmetic liquid sprayed from the mist sprayer 200 to be described below is sprayed into the space between the mask body 100 and the user's face is formed passing through one side of the above-described mask body 100. The above-described cosmetic liquid supply opening 110 is connected to an outlet (not illustrated) of the mist sprayer 200.

Also, a respiratory opening 120 is formed passing through one side of the above-described mask body 100, more preferably, passing through a portion of the mask body 100 which is located in front of the user's nose. One end of the respiratory connector 300 to be described below is connected to the above-described respiratory opening 120 while being inserted thereinto. Therefore, the respiratory opening 120 enables the user not to absorb the cosmetic liquid through the respiratory connector 300 and to breathe outside air through the nose even when the cosmetic liquid is sprayed by the mist sprayer 200 to be described below while the mask body 100 is mounted on the user's face.

In addition, engaging bands 140 for maintaining a stable state while being worn on the user's face may be coupled to the edge portions of the mask body 100. The above-described engaging bands 140 are installed to be engaged with the user's head while surrounding the user's head, or to be engaged with the user's ears while surrounding the user's ears.

Further, a mounting bracket 150, in which one side of the mist sprayer 200 to be described below is detachably installed, may be formed to be coupled to one side of the mask body 100, more preferably, to be coupled to a front surface of the mask body 100 adjacent to the cosmetic liquid supply opening 110. The above-described mounting bracket 150 which is formed to have a ring-shaped cross section so that the one side of the mist sprayer 200 is disposed to be inserted thereinto, more preferably, to have a ring-shaped cross section of which one side is open, may be flexibly deformed, and thus the one side of the mist sprayer 200 may be installed to be easily inserted thereinto even while being inserted and coupled by force.

The mist sprayer 200 sprays the cosmetic liquid onto the cosmetic liquid supply opening 110 of the mask body 100 while storing the cosmetic liquid. In the above-described mist sprayer 200, the outlet (not illustrated) from which the cosmetic liquid sprays is connected to the cosmetic liquid supply opening 110 while being mounted to be inserted into the one side of the mask body 100, more preferably, to be inserted into the mounting bracket 150. Therefore, the mist sprayer 200 sprays the cosmetic liquid into a space between the back surface of the mask body 100 and the face through the cosmetic liquid supply opening 110. Here, the mist sprayer 200 preferably has a known structure in which the cosmetic liquid is automatically sprayed in a mist state vaporized by ultrasound, but the present invention is not limited thereto, and the mist sprayer 200 may also have a known spray spraying structure having a mechanical structure.

The respiratory connector 300 is a portion in which the user is enabled to breathe through the respiratory opening 120 even when the cosmetic liquid is sprayed into the space between the back surface of the mask body 100 and the user's face through the mist sprayer 200 while the mask body 100 is worn on the user's face. The above-described respiratory connector 300 is disposed to surround the user's nose portion while being mounted on the mask body 100 to be connected to the respiratory opening 120 of the mask body 100. That is, the one end of the respiratory connector 300 is connected to the respiratory opening 120 of the mask body 100 while being inserted thereinto, and the other end thereof is disposed to surround the user's nose portion. Here, the respiratory connector 300 includes a connecting rod 310 and a cover body 320.

The connecting rod 310 is installed to be slidably inserted into the respiratory opening 120 of the mask body 100 in forward and backward directions. Here, the connecting rod 310 has a pipe structure in which both longitudinal ends are open. One end of the above-described connecting rod 310 is coupled to be connected to the cover body 320 while being disposed protruding backward from the back surface of the mask body 100, and the other end thereof is disposed protruding forward from the front surface of the mask body 100. In this case, a separation preventing protrusion 311 is formed protruding from an outer side of the other end of the connecting rod 310, that is, the outside of the end protruding forward from the front surface of the mask body 100. The above-described separation preventing protrusion 311 serves to engage with the connecting rod 310 so it does not leave the back surface of the mask body 100 backward while the connecting rod 310 is installed to be inserted into the respiratory opening 120 of the mask body 100. Here, the separation preventing protrusion 311 has a ring shape to be installed and inserted into a groove formed in the outside of the other end of the connecting rod 310, but the present invention is not limited thereto, and the separation preventing protrusion 311 may also be integrally formed protruding from the outside of the other end of the connecting rod.

Here, the connecting rod 310 is preferably formed of a material having ductility to be deformed in upper, lower, left, and right directions while being installed and inserted into the respiratory opening 120 of the mask body 100, but the present invention is not limited thereto, and the connecting rod 310 may be formed to have a bellows structure and be easily deformed in the upper, lower, left, and right directions while minimizing damage due to deformation of the material itself.

The cover body 320 is connected to the connecting rod 310 while covering the user's nose portion, more preferably, while covering the user's nostrils, and enables the user to breathe through the nose while wearing the mask body 100. That is, one side of the cover body 320 is coupled to the one end of the connecting rod 310 protruding backward from the back surface of the mask body 100 to be in communication therewith while having a concave-shaped cross section to cover the user's nose.

Here, a contact unit 321 having ductility may be coupled to edge portions of the cover body 320, that is, an end in contact with the user's face. The above-described contact unit 321 makes the edge portions of the cover body 320 abut the user's face in the sealed state and prevents the cosmetic liquid sprayed into the space between the mask body 100 and the user's face from being absorbed through the user's nose. Here, the contact unit 321 may be formed of rubber or a synthetic resin material having ductility.

An elastic spring 330 which enables the cover body 320 to be in stable close contact with the user's face while the user wears the mask body 100 may be further provided in the above-described respiratory connector 300. That is, the elastic spring 330 elastically supports the cover body 320 to be pressed in a direction of the user's face. The above-described elastic spring 330 is installed to be inserted into the outside of the connecting rod 310 of the respiratory connector 300. In this case, one longitudinal end of the elastic spring 330 is disposed to be connected to the back surface of the mask body 100, and the other longitudinal end thereof is disposed to be connected to the cover body 320.

In this manner, when the elastic spring 330 is installed to be inserted into the outside of the connecting rod 310 of the respiratory connector 300, a protective cover 340 for preventing corrosion of the elastic spring 330 by preventing the cosmetic liquid sprayed from the mist sprayer 200 from coming into contact with the elastic spring 330 may be provided. That is, the protective cover 340 is installed to be inserted into the outside of the connecting rod 310 of the respiratory connector 300 while having a pipe structure to surround the elastic spring 330. In this case, an edge portion of one longitudinal end of the protective cover 340 is disposed at the outside of the connecting rod 310 of the respiratory connector 300 to be in close contact therewith, and an edge portion of the other longitudinal end thereof is disposed at the outside of the cover body 320 of the respiratory connector 300 to be in close contact therewith.

Here, the protective cover 340 is preferably formed of a material having ductility to be deformed in the upper, lower, left, right, front, and back directions while being disposed to be inserted into the outside of the connecting rod 310 of the respiratory connector 300, but the present invention is not limited thereto, and the protective cover 340 may also be formed to have the bellows structure and be easily deformed in the upper, lower, left, right, front, and back directions while minimizing damage due to the deformation of the material itself.

To describe a facial cosmetic method using the cosmetic mask formed in this way according to the embodiment, first, the mask body 100 is worn on a user's face to be in close contact therewith. In this case, the mask body 100 is worn on the user's face to come into close contact with the user's face through pressure by the user's hand or to come into close contact with the user's face by engaging the engaging band 140 with the user's ears or head.

In this case, the cover body 320 of the respiratory connector 300 is disposed to surround the user's nose portion. Here, as described above, the cover body 320 is disposed to come into close contact with the user's face by pushing the connecting rod 310 with the user's hand in a direction of the user's face or to come into close contact with the user's face by an elastic force of the elastic spring 330.

Then, when the mist sprayer 200 operates, the cosmetic liquid is sprayed and supplied into a space between the back surface of the mask body 100 and the user's face through the cosmetic liquid supply opening 110 of the mask body 100, and such a cosmetic liquid is absorbed into skin while coming into direct contact with the user's facial skin.

In this manner, in the cosmetic mask according to the embodiment, when the mask body 100 is worn on the user's face while enabling breathing by the respiratory connector 300, the cosmetic liquid sprayed through the mist sprayer 200 comes into direct contact with the user's facial skin through the cosmetic liquid supply opening 110 of the mask body 100, and thus absorption efficiency of the cosmetic liquid into the user's facial skin is improved.

While the invention has been described with reference to exemplary embodiments illustrated in accompanying drawings, these should be considered in a descriptive sense only, and it will be understood by those skilled in the art that various alterations and equivalent other embodiment may be made. Therefore, the scope of the invention is defined by the appended claims.

The invention claimed is:

1. A cosmetic mask comprising:

a mask body worn on a user's face and having a cosmetic liquid supply opening and a respiratory opening formed therethrough;

a mist sprayer mounted on the mask body to be connected to the cosmetic liquid supply opening and configured to spray a cosmetic liquid into a space between the mask body and the face through the cosmetic liquid supply opening; and a respiratory connector arranged to surround the user's nose portion while being mounted on the mask body to be connected to the respiratory opening, thereby enabling the user to breathe and, wherein the respiratory connector includes:

a connecting rod installed to be slidably inserted into the respiratory opening of the mask body in forward and backward directions and having a pipe structure; and a cover body coupled to one end of the connecting rod protruding backward from the mask body to be in communication therewith.

2. The cosmetic mask of claim 1, wherein a sealing unit having ductility is coupled to an edge portion of the mask body and configured to contact with the user's face.

3. The cosmetic mask of claim 1, wherein an engaging band configured to engage with the user's head or ears is further coupled to the edge portion of the mask body.

4. The cosmetic mask of claim 1, wherein a mounting bracket, into which one side of the mist sprayer is detachably inserted and mounted, is coupled to the mask body.

5. The cosmetic mask of claim 4, wherein the mounting bracket has a ring-shaped cross section of which one side is open.

6. The cosmetic mask of claim 1, wherein the cover body has a concave-shaped cross section to cover the user's nose portion.

7. The cosmetic mask of claim 1, wherein a contact unit having ductility is coupled to an edge portion of the cover body and configured to contact with the user's face.

8. The cosmetic mask of claim 1, wherein a separation preventing protrusion is formed protruding from an outside of the other end of the connecting rod protruding forward from the mask body, and an elastic spring is inserted into an outside of one end of the connecting rod disposed at an inside of the mask body.

9. The cosmetic mask of claim 1, wherein the connecting rod has a bellows structure.

10. The cosmetic mask of claim 8, wherein a protective cover is further installed to be inserted into the outside of the connecting rod to surround the elastic spring.

11. The cosmetic mask of claim 10, wherein the protective cover has a bellows structure.

* * * * *